United States Patent [19]

Kuchler

[11] Patent Number: 4,804,200

[45] Date of Patent: Feb. 14, 1989

[54] SLIDING DEVICE, PARTICULARLY ALPINE SKI

[76] Inventor: Walter Kuchler, Langernstr. 51, D-4712 Werne, Fed. Rep. of Germany

[21] Appl. No.: 2,690

[22] PCT Filed: Feb. 13, 1986

[86] PCT No.: PCT/DE86/00049

§ 371 Date: Nov. 28, 1986

§ 102(e) Date: Nov. 28, 1986

[87] PCT Pub. No.: WO86/04824

PCT Pub. Date: Aug. 28, 1986

[30] Foreign Application Priority Data

| | | | |
|---|---|---|---|
| Feb. 15, 1985 | [DE] | Fed. Rep. of Germany | 3505255 |
| Mar. 23, 1985 | [DE] | Fed. Rep. of Germany | 3510717 |
| Sep. 17, 1985 | [DE] | Fed. Rep. of Germany | 3533043 |
| Sep. 23, 1985 | [DE] | Fed. Rep. of Germany | 3533904 |

[51] Int. Cl.[4] ..... A63C 5/07

[52] U.S. Cl. ..... 280/602; 280/607; 280/609

[58] Field of Search ..... 280/602, 607, 609, 610, 280/617, 633, 636

[56] References Cited

U.S. PATENT DOCUMENTS

| | | | |
|---|---|---|---|
| 2,434,851 | 1/1948 | Hoerle | 280/610 |
| 2,539,224 | 2/1946 | Beerli | 280/602 |
| 2,550,002 | 4/1951 | Chorney | 280/610 |
| 2,661,219 | 12/1953 | Coulson, Jr. | 280/602 |
| 3,260,532 | 7/1966 | Heuvel | 280/602 |
| 3,514,119 | 5/1970 | Sutherland | 280/617 |
| 3,628,802 | 12/1971 | Hashimoto et al. | 280/610 |
| 3,817,543 | 6/1974 | Haff | 280/636 |
| 4,139,214 | 2/1979 | Meyer | 280/607 |

FOREIGN PATENT DOCUMENTS

| | | | |
|---|---|---|---|
| 2723864 | 11/1978 | Fed. Rep. of Germany | 280/607 |
| 3248182 | 6/1984 | Fed. Rep. of Germany . | |
| 810762 | 3/1937 | France . | |
| 1064572 | 5/1954 | France . | |
| 1304880 | 8/1962 | France . | |
| 2338720 | 8/1977 | France . | |
| 110764 | 7/1925 | Switzerland | 280/609 |

*Primary Examiner*—David M. Mitchell
*Assistant Examiner*—Brian L. Johnson
*Attorney, Agent, or Firm*—Herbert Dubno

[57] ABSTRACT

The present sliding device (1), particularly an alpine ski, is formed by upper and lower parts (2, 3) connected by spacing parts (6, 7). A torsion-resistant box (49) formed by the parts (2, 3; 6, 7) in the region close to the binding ends, is capable of elastically absorbing loads or shocks through the interval (37) maintained between the upper and lower parts. A sliding device of this kind relieves the strain on the human motor system and, at the same time, improves the sliding performance.

8 Claims, 2 Drawing Sheets

SLIDING DEVICE, PARTICULARLY ALPINE SKI

CROSS REFERENCE TO RELATED APPLICATIONS

This application is a National Phase application corresponding to PCT/DE86/00049 filed Feb. 13, 1986 and based, in turn, upon Federal Republic of Germany applications P 35 05 255.4 filed Feb. 15, 1985, P 35 10 717.0 filed Mar. 23, 1985, P 35 33 043.0 of Sept. 17, 1985 and P 35 33 904.7 of Sept. 23, 1985 under the International Convention.

FIELD OF THE INVENTION

The invention relates to a sliding device, particularly an alpine ski, with two superposed and mutually attached body portions made of wood, metal, synthetic material or the like, capable of elastically absorbing a load acting upon them because of a spacing maintained between the two portions.

BACKGROUND OF THE INVENTION

During a fast ride with an alpine ski, water ski, sled or surfboard, strong vibrations are transmitted to the rider due to the bumpiness of the ground or the shock of the waves. These vibrations must be absorbed by the joints and entire motor system of the skier. Injuries of the ankle articulation, the Achilles tendon, as well as of the meniscus and the ligament disks occur during overload. These overloads, at best, result in rapid overtiring and an unsafe ride. The rapidly changing strains present in all of these sports, especially, create big problems.

Attempts have already been made to absorb all these stresses in the ski itself, based upon its particular construction. Thus, it is known from German open application 19 01 614, German published specification 14 78 153, the German published specification 17 03 766 and the German Utility Model 82 04 143 to absorb shocks with damping elements, located particularly in the area of the ski binding. However, this is possible only to a limited extent and does not affect positively the characteristics of the ski itself.

OBJECT OF THE INVENTION

It is the object of the invention to provide a sliding device, especially ski, of the afore-mentioned kind which relieves considerably the strain on the human motor system and, at the same time, improves the sliding performance.

SUMMARY OF THE INVENTION

The problem is solved in accordance with the invention by connecting the body portions to each other in a torsion-resistant manner in the high-stress area which, in the case of the alpine ski, for instance, is the area close to the front and the back of the binding, thereby forming a laterally-open torsion-resistant box for the absorption of the ocurring stresses.

The gliding apparatus has a high degree of self-damping with respect to vibrations, because the area of the binding can be provided with effective and well-calculated damping means. Due to the torsion-resistant connection, the sliding device has excellent sliding characteristics, even over hard and icy tracks. The two superimposed body portions create a damping system, so that the strain on the human motor apparatus is considerably diminished. Altogether, improved gliding and running characteristics result, which can be seen particularly in slalom skiing which can be performed more precisely. This effect is due to the fact that a more even pressure transmission from the skier to the sliding surface is achieved. As a whole, a ski, or a sliding surface, results which presents considerable improvements for the beginner, as well as for the competion level.

Furthermore, simpler and cheaper manufacturing processes are applicable. In this case, the complicated constructions of skis can be avoided, since an even pressure transmission is ensured by the torsion-resistant box. Through the concentration of the torsional load on the torsion-resistant segment, the holding, as well as the turning and steering performances of the gliding device are all brought together in this short zone of the torsion-resistant segment. Due to high specific edge pressures, gliding characteristics similar to skating result. The torsion-resistant connection between the body portions, according to the invention, is effected by spacers which are arranged correspondingly at intervals, in front and in the back of the binding. Preferably, these spacers are displaceable, and namely in the longitudinal direction of the body portion. Thus, a simple, individual adjustment of the gliding device is possible.

The spacers can be detachably connected to the body portions. Through the modification of the distance between the displaceable spacers or of the height of the spacers, by corresponding replacing thereof, the damping characteristics can also be modified. This is of particular importance in the case of an alpine ski, since the ski can be adjusted optimally according to the weight and the skill of the skier.

It is advantageous to ensure that the upper body portion has a length corresponding to the length of the torsion-resistant box or slightly longer. This ensures that the weight of the gliding device as a whole is not increased considerably. Besides, the entire gliding device, except for the torsion-resistant box itself, can be relatively soft, so that, on the one hand, the skating effect is not diminished and, on the other hand, the frontal shocks can be absorbed and balanced.

An embodiment which serves the purpose provides that the body portions constituting the torsion-resistant box are made from a solid, directly connected to each other in a torsion-resistant manner. In this manner the gliding device can be made of one solid piece. The torsion box is built in this case through a kind of division of the lower body portion and a corresponding bulging of the upper body portion in the area of the torsion-resistant box. The result is a sliding device with an appealing shape, with a clearance in the main-load area, as has been mentioned previously.

According to a further advantageous embodiment a torsion-resistant box is created by an upper body portion and an additional body portion, and in the assembled state is connected to the lower body portion, in a slide-resistant manner. The torsion-resistant box can be adjusted in this manner to the respective conditions, namely the running characteristics and skills of each user, in a simple and suitable manner, by simply replacing it. This way, it can be manufactured as a finished part and also handled as such, preferably it can be mounted on available sliding devices, particularly skis.

The best suited sliding device for various uses is a device wherein the lower body portion is evenly levelled in the middle and curves away from the gliding surface, towards the ends. First of all, it is simple to manufacture such a sliding device and, in addition, it is possible to use the same ski in deep snow, as well as on a hard track. A further advantageous construction provides that the frontal part of the gliding device will taper off gradually from the torsion-resistant box towards the tip, so that the edge grip of the ski in the area of the torsion box is not diminished, but on the contrary, the edge grip is optimized precisely in this area.

Depending on the purpose of use and goal, it can be especially suitable for the sake of appearance and for the construction of a device very similar to the heretofore known ski, to build the body portions with equal length and width and to add to the spacers forming the torsion box, further spacers distributed outside the torsion-box area, for their connection. Thus a sliding device is created, which has a higher weight due to the double construction, but provides the benefit of an advantageously enclosed unit. The effect of the torsion box is insured, since it is predetermined by the spacers defining the box, while the remaining spacers, preferably arranged at the ends of the two body portions, have essentially only the function to connect effectively the two body portions also in these areas.

Finally, the upper body portion, corresponding to the load applied on its surface, can be wider and that the lower body portion, departing therefrom, be more narrowly dimensioned.

In this manner the skating-like features are created on purpose, whereby, based on the distance between the two body portions, it is ensured that the upper body portion will not impair the leading function of the lower body portion or can impair such function only in very special cases.

The absorption of frontal shocks, as mentioned, is achieved due to the fact that the lower body portion is sufficiently flexible in the area outside the range of the torsion-resistance box. The absorption of such frontal shocks can also be achieved due to the fact that the spacers are rigidly connected to the lower body portion, while with respect to the upper body portion, they are longitudinally movable to a limited extent and laterally guidable. The upper body portion carrying the binding can thus move with respect to the lower body portion carrying the gliding surface, so that shocks can be intercepted not only in a vertical direction, but in a controlled manner also in a horizontal direction, without leaving this burden to the motor system of the user. The longitudinal mobility is achieved, for instance, by the fact that the spacers are held in slits in the upper body portion or have pegs guided in these slits, so that the torsion-resistant construction is preserved.

In order to prevent snow or other materials from lodging between the two body portions, an embodiment of the invention provides rubber sponge plates which fill the space between the body portions and are located at a distance from the edges, or longitudinally running strips of rubber sponge at the edges. The rubber sponge plates and the rubber sponge strips have no damping effects, they are provided only to fill the space between body portions preventing the intrusion of snow and other particles. The damping effect is achieved and insured only by the two body portions arranged at a distance from each other.

An embodiment developed especially for sleds and bobsleds proposes that the body portions be shaped as sledge runners, each pair of which is assigned to a seat. Based on the damping of the shocks which becomes possible this way, the track-steering is improved with the sled. At the same time, due to the uniformity of the counterpressure, a safer and quicker sliding is achieved.

In order to use the advantages of the sliding device also for surfboards it is sufficient to cover the body portions serving as a surfboard with a water-proof outer layer. The buffering of the shock of the waves considerably relieves the human motor system, and, at the same time, improves the contact between the board and the water, and thereby, the maneuverability. The positive lift can be achieved through damping and buffering even at lower speeds than those of the surfboard of known construction. The improved pressure distribution is particularly advantageous, since with little action, the pressure can be transmitted to various parts of the surf board in a controlled manner.

Further, the spacers can be trapezoidally shaped, according to another embodiment particularly suited for alpine skis, so that on both sides different spacings of the body portions can be provided. This embodiment can be especially advantageous when the sliding device is an alpine ski, as mentioned, particularly where slalom or giant-slalom skiing is concerned. When the spacers are higher at the inside of the ski than at its outside, the pressure on the inside of the ski is more strongly transmitted to the ski board, compared to the pressure applied to the outside thereof. This is also advantageous when the skier is bowlegged. But, when the spacers are higher towards the ski outside, it is to the advantage of a pigeon-toed skier.

Particularly for parachute jumpers a foldable, e.g. easily transportable ski is of great advantage. According to the invention, such a ski can be built so that the torsion-resistant box can be longitudinally telescoped or the frontal part of the ski can be insertable into the torsion-resistant box. Thereby, the insertion has to be selected so as to insure that no noticeable negative transition flaws occur in the running surface area.

An especially simple construction according to the invention is a sliding device wherein the torsion-resistant box is a one-piece box and the lower body portion is elastic. Due to this construction, the torsion stresses acting upon the gliding device are introduced into the substrate only over the torsion-resistant segment and not over the entire length of the sliding device, so that basically, the same characteristics are obtained as with the afore-described torsion-resistant box with the vertical spring effect. What is basically reached are the advantageous running characteristics, namely the firm hold, as well as the turning and steering capabilities of the sliding device in this short zone of the torsion-resistant segment. Due primarily to the high specific edge pressure, skate-like features result. Because the torsion strains are not transmitted over the entire length of the gliding device, the torsion resistant segment, as well as the remaining parts of the gliding device can be manufactured in a comparatively simple manner. For instance, the torsion-resistant segment can be, in the most simple case, a piece of wood or synthetic material. The frontal part of the gliding device has to be built considering only the absorption of frontal shocks, for insuring the balance and for the general improvement of the gliding.

Further, a simple and improved sliding device is achieved due to the fact that the upper body portion takes up the function of a binding plate, totally or partially. This has the great advantage that the binding plate is directly integrated with the torsion-resistant box, whereby it affords sufficient damping characteristics with the lower body portion, due to the predetermined length.

The invention has the particularly distinctive characteristic that a sliding device, primarily an alpine ski is created which combines all the extreme points of the types of ski known heretofore, such as long skis for downhill runs and extremely short ones for frozen snowfield gliding, and meets all the requirements of these types. Like the frozen snowfield glider, the ski according to the invention turns well and has a good hold. Like the alpine ski, it rests securely on the surface, passes easily over frontal obstacles such as snow drifts, etc., and offers to the skier a secure foothold against the ocurring vertical shocks, which it absorbs almost entirely. Advantageously, the sliding device according to the present invention can be applied to alpine skis, as well as cross-country skis, sleds, also skibobs, as well as water skis and finally to surfboards.

BRIEF DESCRIPTION OF THE DRAWING

Further details and advantages of this invention will be apparent from the following description and the accompany drawing in which.

SPECIFIC DESCRIPTION

In each of the Figures, an alpine ski is shown as the sliding apparatus 1, having an upper body portion 2 and a lower body portion 3. The upper body portion 2 and the lower body portion 3 are connected to each other in a torsion-resistant manner.

Figure 1:
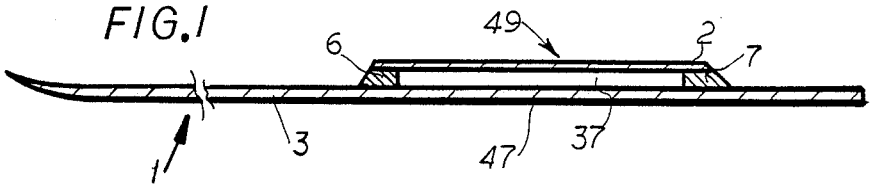
FIG. 1 is a longitudinal section through an alpine ski with a torsion-resistant box.
Figure 5:
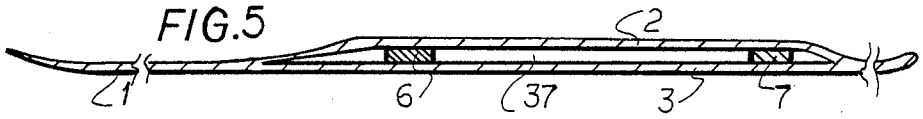
FIG. 5 is a longitudinal section through an alpine ski with an upper body portion slightly extending over the binding portion and spacers.
Figure 6:
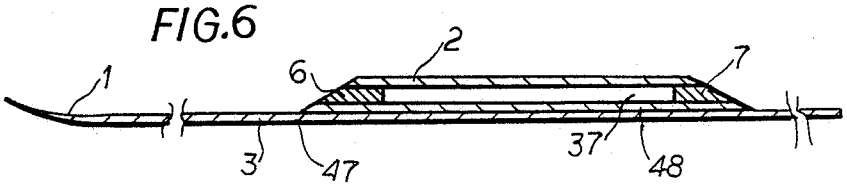
FIG. 6 is a longitudinal section through an alpine ski with superimposable torsion-resistant box.

The torsion-resistant connection is achieved in the embodiment shown in FIG. 1 via the spacers 6, 7 whereby the two body portions 2, 3 are either directly connected through the spacers 6, 7 as in FIG. 1, or, as shown in FIG. 5, through an additionally provided transition of the upper body portion 2 into the lower body portion 3. A further possible construction of the torsion resistant box 49 is shown in FIG. 6. There, an additional body portion 48 is provided, which together with the upper portion 2 and the spacers 6, 7 form the torsion-restant box 49. A uniform distribution of stresses upon the gliding surface 47 results.

Figure 2:
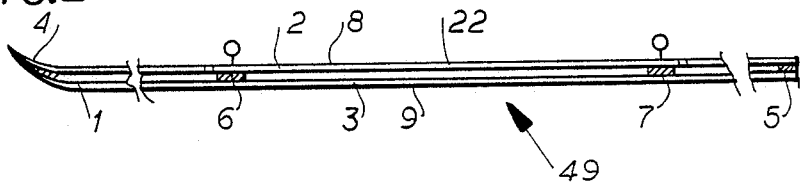
FIG. 2 is a longitudinal section through an alpine ski with parallel body portions.
Figure 3:
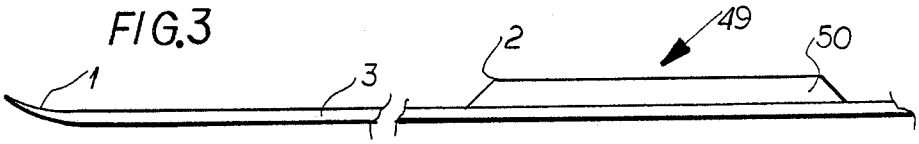
FIG. 3 is a lateral view of an alpine ski with a compact torsion-resistant box.

A further embodiment is shown in FIG. 2 wherein the two body portions 2, 3 are equally long and wide and are placed one on top of the other.

In addition to the spacers 6, 7 they are also connected to each other by the spacers 4, 5 located towards the extremities. However, the torsion-resistant box 49 is defined only between the two spacers 6, 7. The edges of the two body portions 2, 3, except for the edge 9, do not require any special treatment. Even the edge 9 can, as a rule, do without steel protection, because the hold is insured through the torsion-resistant box 49. According to the embodiment of FIG. 2, the connection plate 22 is here also at the same time a part of the upper body portion 2. It is also conceivable, that in an embodiment corresponding to the one in FIG. 1, the entire upper body portion 2 also takes over the function of the connection plate 22.

Figure 4:
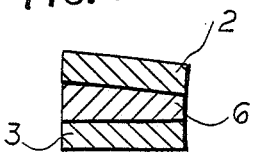
FIG. 4 is a cross section through an alpine ski with trapezoidally shaped spacers.

FIG. 4 shows an embodiment wherein the spacer 6 and spacer 7 (not shown here) are trapezoidally shaped in a manner resulting in an inclined position of the upper body portion 2, which is particularly advantageous for slalom, down-hill run, etc.

Figure 7:
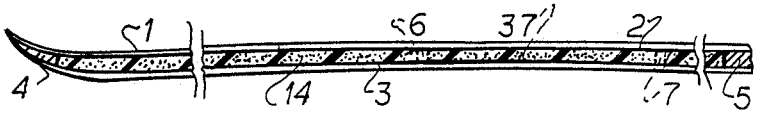
FIG. 7 is a longitudinal section through an alpine ski with filled interval between the two body portions and spacers.

FIG. 7 shows an embodiment in principle similar to the one of FIG. 2, wherein it is shown in detail that interval 37 between the two body portions 2, 3 is closed by a rubber-sponge plate 14, in order to prevent the intrusion of snow. The rubber-sponge plate, in this case, does not have any damping characteristics, it is provided primarily for the closing of this area. Besides, it is possible to provide longitudinal slots in the upper body portion (2), for instance to facilitate the exit of the snow which has already entered the interval, when the use of rubber sponge or the like was not possible, for a reason or another.

Figure 8:
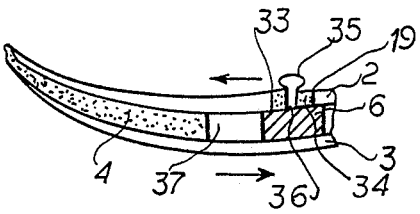
FIG. 8 is the frontal area of an alpine ski in section with horizontal displaceability.

FIG. 8 shows an embodiment wherein the upper body portion 2 is given the possibility to move in longitudinal direction, with respect to the lower body portion 3. Here the spacers 6, 7 are provided with a guide peg 35 whose neck 36 passes through a longitudinal slot 19 of the upper body portion 2. This longitudinal slot 19 is formed in an elastic material 34, so that between the neck 36 and the lateral walls 33 of the longitudinal slot 19 there is practically no clearance left.

More specifically, when the two body portions 2, 3 are displaced longitudinally with respect to each other, this movement is purposely damped by the elastic material 34, respectively the conformation of the longitudinal slots 19 which results in a safe guidance of the upper body and in the preservation of the torsion-resistant box, as a whole.

What is claimed is:

1. A snow ski, comprising:

a longitudinally extending runner having a gliding surface formed on an underside thereof and an upper surface extending from a front end to a rear end of said runner;

an elongated member spaced above said runner only over a portion of the length thereof intermediate said ends and corresponding to a skiboot-supporting region of the ski, said member being parallel to said runner in said region; and a pair of rigid longitudinally spaced spacers affixed to said member and said runner and holding said member above said upper surface at opposite ends of said member, said spacers having substantially trapezoidal shapes with inclined flanks extending from respective end edges of said member to said upper surface, said end edges of said member being beveled to lie flush with said flanks, said member and said spacers defining on said runner a torsionally stiff flexure-resistant torsion box which is laterally open but is closed at its top by said member and at its ends by said spacers, said runner having flexible portions extending beyond said torsion box.

2. The sliding device defined in claim 1 wherein said spacers are detachably connected to said member and said runner.

3. The sliding device defined in claim 1 wherein said member has a length equal to that of said box.

4. The sliding device defined in claim 1 wherein said runner is generally flat in the region of said box and, at least at one of said flexible portions extending beyond said box, said runner is turned upwardly.

5. The sliding device defined in claim 1 wherein said runner tapers toward a ski tip from said torsion box.

6. The sliding device defined in claim 1 wherein said member has the same width as said runner.

7. The sliding device defined in claim 1 wherein said spacers are generally trapezoidal in a transverse section through the device and permit said member and said runner to have different distances between the longitudinal edges thereof.

8. The sliding device defined in claim 1 wherein said member forms a base of a ski binding.

* * * * *